US006513417B1

(12) United States Patent
Sugiura et al.

(10) Patent No.: US 6,513,417 B1
(45) Date of Patent: Feb. 4, 2003

(54) SINGLE-HEADED SWASH-PLATE-TYPE COMPRESSOR WITH HOLLOWED AND RIBBED PISTON

(75) Inventors: Manabu Sugiura, Kariya (JP); Kenji Takenaka, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/690,975

(22) Filed: Oct. 18, 2000

(30) Foreign Application Priority Data

Nov. 8, 1999 (JP) ..... 11-316336

(51) Int. Cl.[7] ..... F01B 3/00; F16J 1/00
(52) U.S. Cl. ..... 92/71; 92/172
(58) Field of Search ..... 92/71, 172; 91/499

(56) References Cited

U.S. PATENT DOCUMENTS 5,174,728 A 12/1992 Kimura et al. ..... 417/222.2
5,765,464 A * 6/1998 Morita ..... 92/71
5,941,161 A * 8/1999 Kimura et al. ..... 92/155

FOREIGN PATENT DOCUMENTS

JP A-11-107912 4/1999

* cited by examiner

*Primary Examiner*—Edward K. Look
*Assistant Examiner*—Michael Leslie
(74) *Attorney, Agent, or Firm*—Woodcock Washburn LLP

(57) ABSTRACT

A single headed swash plate type compressor includes a swash plate and pistons reciprocatingly arranged in cylinder bores. Each piston has a body portion and a neck portion. The body portion of the piston has a cavity to reduce the weight of the piston, and the piston has ribs to reinforce the body portion. A first rib is arranged within the cavity near the front end wall of the body portion, and a second rib is arranged outside the cavity near the front end wall of the body portion.

9 Claims, 4 Drawing Sheets

SINGLE-HEADED SWASH-PLATE-TYPE COMPRESSOR WITH HOLLOWED AND RIBBED PISTON

BACKGROUND OF THE INVENTION

1. Field of the Invention

The present invention relates to a single headed swash plate type compressor used for an air-conditioner incorporated into a vehicle, for example.

2. Description of the Related Art

A conventional single headed swash plate type compressor is disclosed in Japanese Unexamined Patent Publication No. 11-107912. This single headed swash plate type compressor comprises a housing having cylinder bores, a crank chamber, a suction chamber and a discharge chamber, and pistons reciprocatingly arranged in the cylinder bores. A drive shaft is rotatably supported by the housing, and this drive shaft is driven by an external drive source. Further, a swash plate is supported by the drive shaft for rotation therewith, and a pair of shoes is arranged between the swash plate and the piston. That is, the piston has a body portion in slidable contact with the inner circumferential surface of the cylinder bore, and the shoes are connected between the shoe connecting portion (neck portion), which is integrally formed with the body portion, and the swash plate. In this single headed swash plate type compressor, a stroke of the piston and an inclination angle of the swash plate are changed according to a pressure difference between the crank chamber pressure and the suction pressure. Due to the foregoing, the discharge capacity can be controlled. The characteristic structure of the single headed swash plate type compressor, as disclosed in this publication, includes a cavity formed in the body portion of the piston to realize a reduction in weight. Here, the term "cavity" includes a completely closed cavity not communicating with the outside and a partially closed cavity (lightening hole) communicating with the outside via an opening such as a communicating hole.

In this single headed swash plate type compressor, when the drive shaft is driven by the external drive source, the swash plate is rotated synchronously with the drive shaft, and the pistons are reciprocated in the cylinder bores via the shoes. Due to the foregoing, since a compression chamber is formed between the cylinder bore and the piston head, when this compression chamber is in a suction stroke, refrigerant gas at low pressure is sucked into the compression chamber from the suction chamber connected with an evaporator provided in the refrigerating circuit, and when this compression chamber is in a compression stroke, refrigerant gas at high pressure is discharged from the compression chamber into a discharge chamber. The discharge chamber is connected with a condenser provided in the refrigerating circuit. In this way, the refrigerating circuit is used for an air conditioning system incorporated into a vehicle.

In the above described conventional single headed swash plate type compressor, when a cavity is formed in the piston so that the weight of the compressor can be reduced, the mechanical strength of the body portion of the piston is decreased because of the cavity. Especially when an opening, connecting the cavity in the piston with the outside, is formed, there is a possibility that the mechanical strength of a portion of the piston close to the opening becomes insufficient.

SUMMARY OF THE INVENTION

It is an object of the present invention to provide a single headed swash plate type compressor in which, while utilizing the advantages of forming a cavity in the piston, durability of the compressor is enhanced even when it is operated under a severe operating condition.

The present invention provides a single headed swash plate type compressor comprising: a housing having cylinder bores, a crank chamber, a suction chamber and a discharge chamber formed therein; pistons reciprocatingly arranged in the cylinder bores, each piston having a body portion slidably fitted in the cylinder bore and a neck portion connected to the cylinder bore; a drive shaft rotatably supported by the housing; a swash plate arranged in the crank chamber and supported by the drive shaft for rotation therewith, the swash plate being operatively connected to the neck portions of the pistons to move the pistons; the body portion of the piston having a cavity formed therein to reduce the weight of the piston; and the piston having at least one rib to reinforce the body portion.

In the single headed swash plate type compressor of the present invention, the cavity is formed in the body portion of the piston, so the weight of the compressor can be reduced. The cavity may be either a partially closed cavity or a completely closed cavity. In the single headed swash plate type compressor of the present invention, the piston has at least one rib, which reinforces the body portion of the piston. This rib may be located either outside or inside the cavity.

Accordingly, in the single headed swash plate type compressor of the present invention, while realizing a reduction in the weight, which is an advantage of forming the cavity in the piston, durability can be enhanced even if the compressor is operated under a severe operating condition.

In the single headed swash plate type compressor according to the present invention, it is preferable that a pair of shoes are arranged between the piston and the swash plate and that the piston has at least one rib in a portion close to the neck portion of the piston for connecting the shoes. Due to the above structure, it is possible to provide a higher effect of reinforcing the body portion. That is, in the suction or compression stroke, a portion close to the shoe connecting section of the piston mostly receives compression stress, an inertial force and a bending moment. Therefore, it is most effective to arrange the rib in the portion close to the shoe connecting portion.

In the single headed swash plate type compressor according to the present invention, it is preferable that the cavity has openings which open at positions on either side of the neck portion of the piston, and the rib is formed between both the openings. In this arrangement, no burr is left in the cavity in the manufacturing process and welding conducted in vacuum is avoided so that manufacturing can be simply performed. In this structure, a portion between both the openings tends to become relatively fragile, however, when the rib is provided here, it becomes possible to ensure a sufficiently high mechanical strength.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

The single headed swash plate type compressor of the present invention will be explained below referring to the appended drawings.

Figure 1:
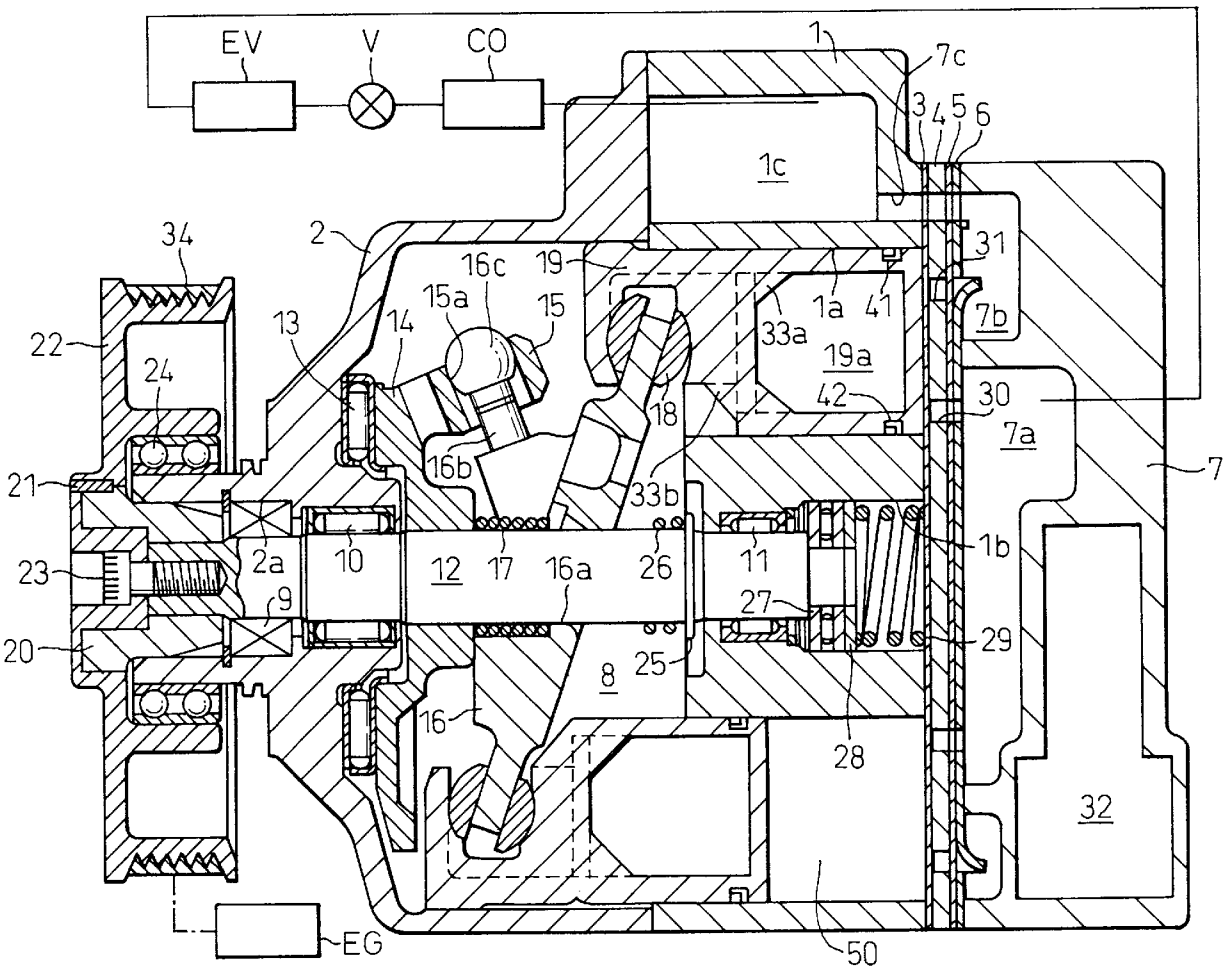
FIG. 1 is an overall longitudinal cross-sectional view of a single headed swash plate type compressor according to the first embodiments of the present invention.
Figure 2:
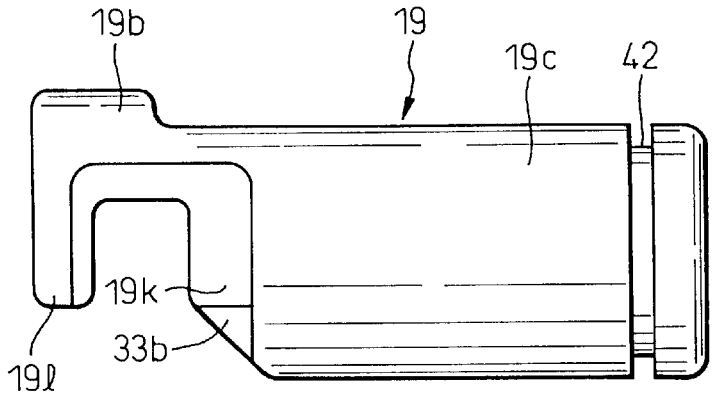
FIG. 2 is a side view of the piston of FIG. 1.

FIG. 1 shows a the single headed swash plate type compressor of the first embodiment, which comprises a cylinder block 1 having a plurality of cylinder bores 1*a*, an axial hole 1*b* and a muffler chamber 1*c* formed therein, a cup-shaped front housing 2 joined to the front end of the cylinder block 1, and a rear housing 7 joined to the rear end of the cylinder block 1 via a suction valve 3, a valve plate 4, a discharge valve 5 and a retainer 6. The cylinder block 1, the front housing 2 and the rear housing 7 constitute the housing of the compressor.

The front housing 2 also has an axial hole 2*a*. A crank chamber 8 is formed in the front end of the cylinder block 1 and the front housing 2, and a drive shaft 12 is rotatably supported by the cylinder block 1 via a shaft seal device 9 and a radial bearing 10 in the shaft hole 2*a* and a radial bearing 11 in the shaft hole 1*b*.

A lug plate 14 is fixed to the drive shaft 12 in the crank chamber 8, with a thrust bearing 13 interposed between the front housing 2 and the lug plate 14. A pair of arms 15 protrude backward from the lug plate 14, each arm 15 having a guide hole 15*a* having a cylindrical inner surface. The drive shaft 12 extends through a through-hole 16*a* of the swash plate 16, and an inclination angle reducing spring 17 is arranged between the swash plate 16 and the lug plate 14. The swash plate 16 is urged by the inclination angle reducing spring 17 in the direction in which the inclination angle changes from the maximum inclination angle to the minimum inclination angle.

At the front end of the swash plate 16, a pair of guide pins 16*b* protrude toward the arms 15, and the forward end of each guide pin 16*b* has a guide portion 16*c* having a spherical outer surface, which is rotatable and slidable in the guide hole 15*a*. In the peripheral edge of the swash plate 16, there are provided pistons 19 which are engaged with the swash plate 16 via pairs of shoes 18. Each piston 19 is arranged in each cylinder bore 1*a*.

A boss 20 is engaged by means of spline with a portion of the drive shaft 12 protruding forward from the front housing 2, and the boss 20 is fixed to a pulley 22 by a key 21. The pulley 22 is fixed to the drive shaft 12 by a bolt 23 and supported by the front housing 2 via a bearing 24. A belt 34 connected with engine EG, which is an external drive source, is wound around the pulley 22.

A return spring 26 is provided around the drive shaft 12 on the rear side of the swash plate 16 and retained by the circlip 25. A thrust bearing 27 and a washer 28 are arranged in the axial hole 1*b* of the cylinder block 1 at the rear end of the drive shaft 12. Between the washer 28 and the suction valve 3, there is provided a spring 29.

A suction chamber 7*a* is provided in the rear housing 7. The suction chamber 7*a* is communicated with each cylinder bore 1*a* through the suction port 30 formed in the retainer 6, the discharge valve 5 and the valve plate 4. The suction chamber 7*a* is connected with an evaporator EV of the external refrigerating circuit by piping. Evaporator EV is connected with a condenser CO via an expansion valve V by piping. A discharge chamber 7*b* is provided around the rear housing 7. The discharge chamber 7*b* and the muffler chamber 1*c* of the cylinder block 1 are communicated with each other by a discharge passage 7*c* formed through the retainer 6, the discharge valve 5, the valve plate 4 and the suction valve 3. The muffler chamber 1*c* is connected with a condenser CO of the refrigerating circuit by piping. The discharge chamber 7*b* is communicated with each cylinder bore 1*a* by a discharge port 31 formed through the valve plate 4 and the suction valve 3. A control valve 32 is arranged in the rear housing 7. Due to the above structure, the discharge capacity of the single headed swash plate type compressor is controlled by changing the stroke of the piston 19 and the inclination angle of the swash plate 16 according to a pressure difference between the pressure in the crank chamber 8 and the suction pressure in the suction chamber 7*a*.

Figure 3:
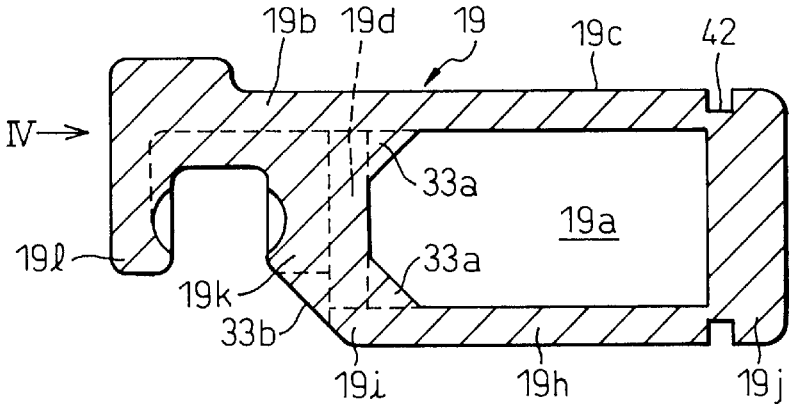
FIG. 3 is a longitudinal cross-sectional view of the piston of FIG. 2.
Figure 4:
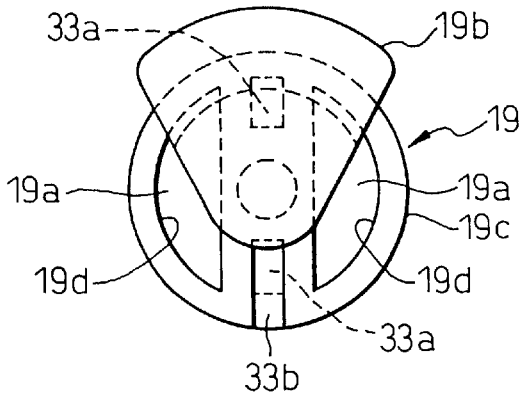
FIG. 4 is a front view, showing the piston of FIGS. 2 and 3, as viewed from the arrow IV in FIG. 3.

As shown in FIGS. 1 to 4, the piston 19 of the single headed swash plate type compressor has a body portion 19*c* which is a portion slidably fitted in the inner circumferential surface of the cylinder bore 1*a*, and a neck portion 19*b* connected to the body portion 19*c* so as to project from the cylinder bore 1*a* for connection to the swash plate. A ring groove 42 is provided on the body portion 19*c* near the head thereof. A piston ring 41 slidably coming into contact with the inner circumferential surface of the cylinder bore 1*a* is fitted in the ring groove 42. The body portion 19*b* comprises a cylindrical hollow wall 19*h*, a front end wall 19*i* located at one end of the cylindrical hollow wall 19*h*, and a rear end wall 19*j* located at the other end of the cylindrical hollow wall 19*h*. The cylindrical hollow wall 19*h*, the front end wall 19*i* and the rear end wall 19*j* together define the cavity 19*a*. The neck portion 19*b* comprises a pair of axially spaced engaging walls 19*k* and 19*l*. The shoe 18 is arranged between each of the engaging walls 19*k* and 19*l* and the swash plate 16. One of the engaging walls 19*k* and 19*l* located on the side of the front end wall 19*i* of the body portion 19*b* is contiguous to and integral with the latter. The neck portion 19*b* is upwardly offset with respect to the body portion 19*b*, as shown in FIG. 4. The body portion 19*c* of the piston 19 has a cavity 19*a* to reduce the weight of the piston 19. The cavity 19*a* can be formed as a partially closed cavity (lightening hole) or a completely closed cavity. Especially, as shown in FIG. 3, a pair of triangular ribs 33*a* are arranged within the cavity between the front end wall 19*i* and the cylindrical hollow wall 19*h*. Also, a triangular rib 33*b* is provided outside the cavity 19*a* between the body portion 19*c* and the engaging wall 19*k* at a radially symmetrical position with respect to the neck portion 19*b*. Further, as shown in FIGS. 3 and 4, a pair of openings 19*d* are formed in and through the front end wall 19*i* of the body portion 19*c* at positions on either side of the rib 33*b*. The cavity 19*a* is thus communicated with the crank chamber 8 via the openings 19*d*. The rib 33*b* is arranged between the openings 19*d*.

In the single headed swash plate type compressor described above, the swash plate 16 is rotated synchronously with the drive shaft 12 when the drive shaft 12 is driven by the engine EG, and the pistons 19 are reciprocated in the cylinder bores 1*a* via shoes 18. The compression chamber 50 is formed between the cylinder bore 1*a* and the head of the piston 19, so the refrigerant gas at low pressure is sucked from the suction chamber 7*a*, which is connected with the evaporator EV of the refrigerating circuit, into the compression chamber 50 when the compression chamber 50 is in a suction stroke. Refrigerant gas at high pressure is discharged from the compression chamber 50 into the discharge chamber 7*b* when the compression chamber 50 is in a compression stroke. In this way, the refrigerating circuit works as an air conditioning system for vehicle use.

Since the cavity 19*a* is formed in the piston 19 of this single headed swash plate type compressor, as shown in FIG. 3, the weight of the compressor can be reduced.

In the single headed swash plate type compressor, the ribs 33*a* are provided in the cavity 19*a* of the piston 19, and also the rib 33*b* is provided between the body portion 19*c* of the piston 19 and the neck portion 19*b*, so that the body portion 19*c* of the piston 19 is reinforced and the mechanical strength is enhanced. Since the ribs 33*a* and 33*b* are arranged close to the neck portion 19*b* to which compression stress, an inertial force and a bending moment are mostly given, the effects of the ribs are large. In this piston 19, the rib 33*b* is provided at a position between the openings 19*d* at which the piston tends to be fragile. Therefore, a sufficiently high mechanical strength can be ensured.

Accordingly, in the single headed swash plate type compressor of this embodiment, the advantage of the cavity 19*a* in the piston 19 to reduce the weight is obtained and, at the same time, durability of the compressor can be enhanced even when it is operated under a severe operating condition.

As shown in FIG. 4, the cavity 19*a* of the piston 19 has openings 19*d* which are opened at positions on either side of the neck portion 19*b*. Therefore, even in the case of a structure in which the piston 19 is made by the welding of axially divided parts, it is easy to remove foreign matter or burrs generated in the welding process from the opening 19*d*, so that burrs are not left in the cavity portion 19*a*. Due to the foregoing, the occurrence of noise can be prevented and, further, it is possible to prevent such an inconvenience that the burrs enter the crank chamber 8 in the process of operation.

When the divided parts are welded, since the openings 19*d* allow the cavity 19*a* located inside the piston 19 to be communicated with the outside, there is no possibility of defective welding which may be caused by expansion of the inside air in the case where the inside is formed into a completely closed cavity. Therefore, it is unnecessary to conduct welding in a vacuum, and the manufacturing is simple, so that the manufacturing cost can be reduced.

Figure 5:
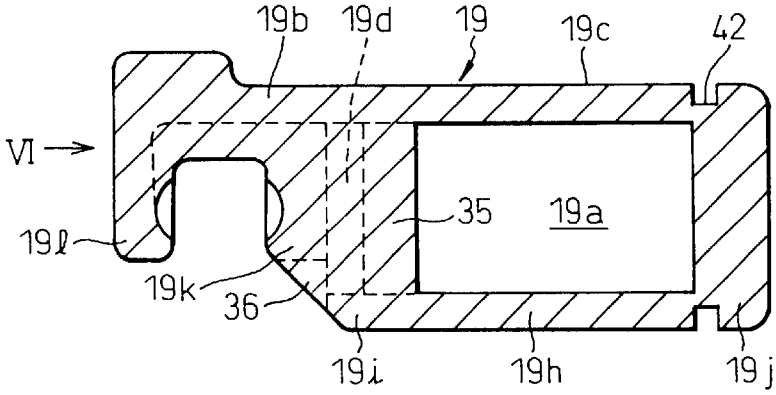
FIG. 5 is a longitudinal cross-sectional view of another embodiment of the piston.
Figure 6:
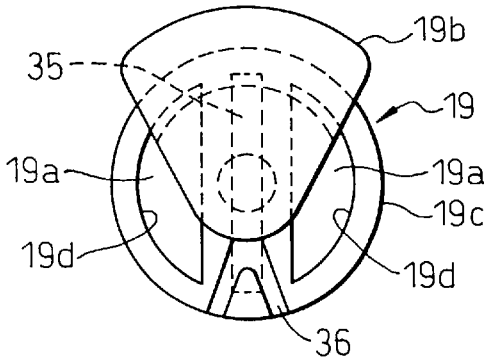
FIG. 6 is a front view of the piston of FIG. 5 as viewed from the arrow VI in FIG. 5.

FIGS. 5 and 6 show another embodiment of the piston 19. In the single headed swash plate type compressor of this embodiments, a plate-shaped rib 35 is arranged in the cavity 19 between the front end wall 19*k* and the cylindrical hollow wall 19*b* and diametrically extends in the cylindrical hollow wall 19*b*. As shown in FIG. 6, between the body portion 19*c* and the neck portion 19*b*, there is provided a forked rib 36 which extends outside and is located between the pair of openings 19*d*. The other structures are the same as those of the first embodiment.

The single headed swash plate type compressor described above provides the same action and effect as those of the first embodiment.

Figure 7:
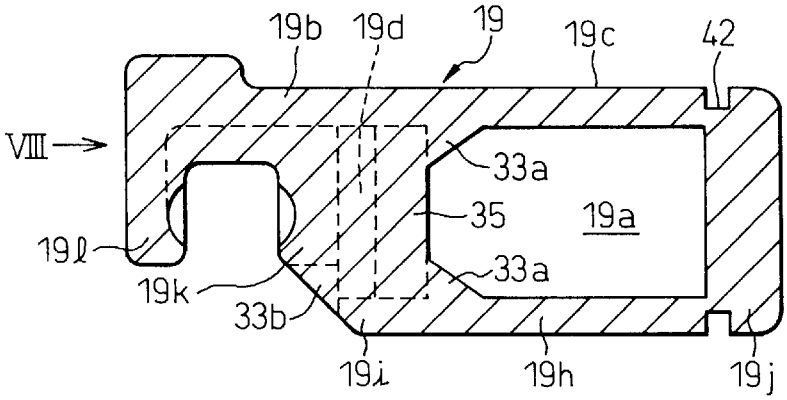
FIG. 7 is a longitudinal cross-sectional view of a further embodiment of the piston.
Figure 8:
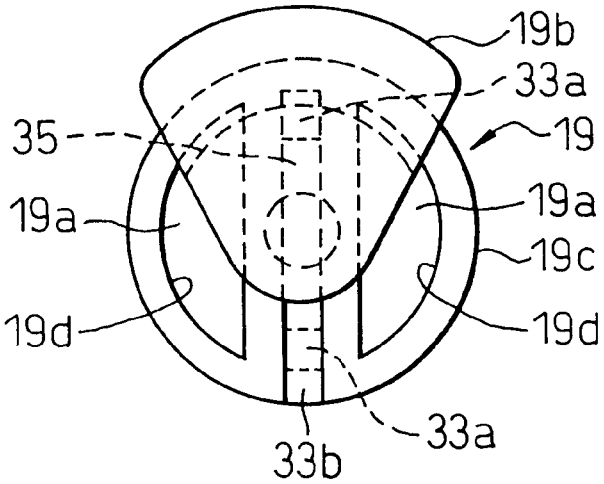
FIG. 8 is a front view of the piston of FIG. 7 as viewed from the arrow VIII in FIG. 7.

FIGS. 7 and 8 show a further embodiment of the piston 19 in the single headed swash plate type compressor of this embodiment. A plate-shaped rib 35 is arranged in the cavity 19*a* between the front end wall 19*k* and the cylindrical hollow wall 19*b* and diametrically extends in the cylindrical hollow wall 19*b*. At the same time, there are provided triangular ribs 33*a* coming into contact with the inner circumferential surface and the rear end surface of the plate-shaped rib 35. Other structures are the same as those of the first embodiment.

The single headed swash plate type compressor described above provides the same action and effect as those of the first embodiment.

In the first to third embodiments described above, the cavity is a lightening hole 19*a*. However, it is possible to apply the present invention to a case in which cavity is a completely closed cavity.

What is claimed is:

1. A single headed swash plate type compressor comprising:

a housing having cylinder bores, a crank chamber, a suction chamber and a discharge chamber formed therein;

pistons reciprocatingly arranged in said cylinder bores, each piston having a body portion slidably fitted in said cylinder bore and a neck portion connected to said body portion;

wherein said neck portion comprises a pair of axially spaced engaging walls;

a drive shaft rotatably supported by said housing;

a swash plate arranged in said crank chamber and supported by said drive shaft for rotation therewith, said swash plate being operatively connected to said neck portions of said pistons to move the pistons;

a shoe arranged between each of said engaging walls and said swash plate;

said body portion of said piston having a cavity formed therein to reduce the weight of said piston; and said piston having at least one rib to reinforce said body portion, said at least one rib being arranged in said piston on said engaging wall located on the side of said body portion and outside said cavity.

2. A single headed swash plate type compressor according to claim 1, wherein said at least one rib further comprises at least a second rib located on the side of the body portion and inside said cavity.

3. A single headed swash plate type compressor according to claim 1, wherein said cavity comprises one of a partially closed cavity and a completely closed cavity.

4. A single headed swash plate type compressor according to claim 3, wherein said cavity comprises a partially enclosed hollow hole having openings at positions on either side of said neck portion, said at least one rib being located between said openings.

5. A single headed swash plate type compressor according to claim 1, wherein said cavity comprises a partially enclosed hollow hole having openings at positions on either side of said neck portion, said at least one rib being located between said openings.

6. A single headed swash plate type compressor according to claim 5, wherein said first rib extends between said front end wall and said cylindrical hollow wall, and said second rib extends between said front end wall and said one engaging wall.

7. A single headed swash plate type compressor according to claim 5, wherein said cavity comprises a partially closed cavity having openings extending through said front end wall at positions on either side of said one engaging wall, and at least one rib is located between said openings.

8. A single headed swash plate type compressor according to claim 7, wherein said openings have a sufficiently large size to allow removal of foreign matter from said cavity which may be produced when said body portion is made of a plurality of pieces and said pieces are joined together.

9. A single headed swash plate type compressor according to claim 1, wherein said swash plate is tiltably supported by said drive shaft so that a discharge capacity of the compressor can be controlled by changing an inclination angle of said swash plate and thus changing a stroke of said pistons depending on a pressure difference between a crank chamber pressure and a suction chamber pressure.

* * * * *